US006736938B2

(12) United States Patent
Haraldsson

(10) Patent No.: US 6,736,938 B2
(45) Date of Patent: May 18, 2004

(54) HEADBOX AND ARRANGEMENT AND METHOD FOR MOUNTING A VANE THEREOF

(75) Inventor: Ulf Haraldsson, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/290,773

(22) Filed: Nov. 8, 2002

(65) Prior Publication Data

US 2003/0056924 A1 Mar. 27, 2003

Related U.S. Application Data

(63) Continuation of application No. PCT/SE01/00911, filed on Apr. 27, 2001.
(60) Provisional application No. 60/206,404, filed on May 23, 2000.

(30) Foreign Application Priority Data

May 10, 2000 (SE) ..... 0001717-8

(51) Int. Cl.[7] ..... D21F 1/02; D21F 1/06
(52) U.S. Cl. ..... 162/343; 162/336
(58) Field of Search ..... 162/343, 344, 162/336, 216, 272, 212, 259, 341, 344.7, 315

(56) References Cited

U.S. PATENT DOCUMENTS

| | | | | |
|---|---|---|---|---|
| 3,888,729 A | | 6/1975 | Parker et al. | |
| 4,133,715 A | | 1/1979 | Hergert | |
| 4,181,568 A | * | 1/1980 | Pfaler | 162/343 |
| 4,298,429 A | * | 11/1981 | Hergert et al. | 162/343 |
| 4,504,360 A | | 3/1985 | Fujiwara | |
| 4,617,091 A | | 10/1986 | Rodal et al. | |
| 4,941,950 A | | 7/1990 | Sanford | |
| 5,545,294 A | | 8/1996 | Linden et al. | |
| 6,165,324 A | | 12/2000 | Linden | |

FOREIGN PATENT DOCUMENTS

| | | |
|---|---|---|
| GB | 2 119 824 A | 11/1984 |
| WO | WO 98/50625 | 11/1998 |

* cited by examiner

*Primary Examiner*—Karen M Hastings
*Assistant Examiner*—Eric Hug
(74) *Attorney, Agent, or Firm*—Alston & Bird LLP

(57) ABSTRACT

A vane is mounted to a turbulence generator in a headbox by a mounting arrangement that includes an assembly bar that is rigidly connected to an anchoring element of the turbulence generator. The anchoring element has an engagement groove of dovetail shape that receives a similarly shaped protrusion on the assembly bar to rigidly mount the assembly bar to the anchoring element. The assembly bar also includes a continuous journaling groove configured to receive a pivot member of the vane to fix the vane to the assembly bar while leaving the vane free to pivot about a pivot axis that extends in the cross-machine direction.

21 Claims, 2 Drawing Sheets

HEADBOX AND ARRANGEMENT AND METHOD FOR MOUNTING A VANE THEREOF

CROSS-REFERENCE TO RELATED APPLICATIONS

This application is a continuation of International Patent Application PCT/SE01/00911 filed Apr. 27, 2001, incorporated herein by reference, which designated inter alia the United States and was published in English under PCT Article 21(2), and which claims benefit of U.S. Provisional Application No. 60/206,404, filed May 23, 2000.

FIELD OF THE INVENTION

The present invention relates to a headbox for delivering a jet of stock to a forming zone in a former for wet-forming a fiber web, and relates more particularly to the mounting of vanes within a slice chamber of a multi-layer headbox via an arrangement that allows each vane to pivot about its attachment to a turbulence generator of the headbox.

BACKGROUND OF THE INVENTION

In papermaking, a web is formed in a former of the papermaking machine by delivering a jet of papermaking stock from a headbox to a forming zone of the former. A headbox generally comprises a slice having a slice chamber and a slice opening, and a turbulence generator that includes a plurality of turbulence channels that open out into the slice chamber for delivering stock into the slice chamber. Within the slice chamber, the flow of stock is divided into a plurality of separate channels by vanes that are mounted in the slice chamber, each vane typically being mounted to an elongate anchoring element arranged between adjacent rows of turbulence channels of the turbulence generator. The anchoring element typically has a continuous engagement groove that is open towards the slice chamber to facilitate mounting the vane to the anchoring element.

SE-511 684 C2 describes a multi-layer headbox with vanes that each have a connection bar with a flexible engagement part for pivotable journaling of the vane to an anchoring element that is fixedly arranged between two rows of turbulence channels. The headbox is of the rectilinear type, i.e., at least the intermediary channels extend in line with the turbulence channels. However, the described fastening of the vane directly to the anchoring element is not suitable in the case of a headbox of the angled type, in which all the vanes and channels in the slice chamber extend at an angle to the turbulence channels, as the axis of pivot is located inside the anchoring element such that the pivoting capacity of the vane would be insufficient, and the vane and connection bar are too close to the opening of the turbulence channel. Furthermore, the described fastening is not applicable in the case of an anchoring element having a dovetail-shaped groove for the connection bar.

Various solutions have been suggested for mounting a vane aligned at an angle to an anchoring element in a turbulence generator. U.S. Pat. No. 4,133,715 describes turbulence vanes that each have a connection bar consisting of a flexible material and having an extended intermediate part and a wedge-shaped engagement part that is received in a dovetail groove. A change in the position of the vane, due to differences in pressure between the two channels separated by the vane, result in corresponding bending of the long intermediate part. Repeated bending results in flexure fatigue in the material and a risk of the intermediate part fracturing. The bending of the intermediate part also causes the vane to be displaced in its plane so that the downstream end of the vane changes its position relative to the slice opening in proportion to the magnitude of the bending of the intermediate part. Such a change in position of the downstream edge is not acceptable in respect of a stock-separating vane in a multi-layer headbox, as it would affect the layers of the jet of stock detrimentally in the proximity of the slice opening.

WO 98/50625 describes vanes that each have a connection bar made of stainless steel. The connection bar has an extended intermediate part that is curved to retain the vane at an angle to the turbulence channel. The engagement part of the connection bar is dovetail-shaped to co-operate securely with the dovetail groove in the engagement part to provide a rigid joint. It will be appreciated that the vane and the connection bar are subjected to significant and repeated strains when differences in pressure arise between the two channels that are separated by the vane, so that there is a significant risk of a fracture occurring in the vane adjacent to the connection bar and/or in the connection bar, especially at the root of the dovetail-shaped engagement part. The last-mentioned document acknowledges the problem with such a rigid anchoring of the vane and therefore suggests a modified connection bar, the engagement part of which is fashioned with a circular cross section to form a joint so that the vane can pivot. A potential pivoting of the vane results in a change in position of the downstream edge of the vane, which is not acceptable for a stock-separating vane in a multi-layer headbox. However, it will be appreciated, of course, that the pivoting function is lost after a relatively short period of operation, as the circular joint will get wedged and assume a stationary position impervious to pivoting, which wedge locking occurs because of the tensile forces created by the stocks in the vane. Accordingly, the modified connection bar will function in the same unsatisfactory way as the first described connection bar with the rigid dovetail joint.

When a vane and/or its connection bar with the fastening systems described above has (have) been damaged, there has hitherto been no alternative and better arrangement for the mounting of the vane to reduce the operational disruptions and replacements. This applies particularly to headboxes where the anchoring elements of the turbulence generator are provided with dovetail grooves and the vanes are positioned at an angle relative to the turbulence channels.

Further suggestions for fastening a vane to a turbulence generator are described in SE-440 924, U.S. Pat. No. 4,617,091, U.S. Pat. No. 4,941,950, and U.S. Pat. No. 5,013,406.

SUMMARY OF THE INVENTION

The present invention addresses the problems mentioned above and seeks to provide a mounting arrangement for the vanes of the headbox that is simple in its construction and easy to install and which reduces the risk of damage to the vanes and their potential connection bars. The invention offers a simple and reliable way to replace existing fastening systems with a mounting arrangement in accordance with the invention, for instance in connection with re-construction of an already installed headbox. A headbox and mounting arrangement in accordance with the invention includes a slice defining a slice chamber and a slice opening, at least one vane arranged in the slice chamber to divide the flow of stock into at least two separate channels, a turbulence generator defining a plurality of turbulence channels corresponding to the number of channels in the slice chamber, each turbulence channel feeding stock to one of the channels in the slice chamber, the turbulence generator having an anchoring element for each vane, each anchoring element being arranged between adjacent turbulence channels, and a mounting arrangement for mounting each vane to the corresponding anchoring element. The mounting arrangement comprises a coupling element disposed at an upstream end of the vane, and an assembly bar extending along the anchoring element and adapted to receive the coupling element of the vane.

In accordance with one preferred embodiment of the invention, the headbox, as well as the mounting arrangement, is characterized in that the assembly bar has

- a protrusion that is arranged to be received in the engagement groove of the anchoring element to form a rigid joint and
- a continuous journaling groove that is arranged at a pre-determined distance from the anchoring element and is open towards the vane by way of a side opening, and has opposite pivot surfaces, and that the pivot member of the vane is arranged to be received in the journaling groove to co-operate with its pivot surfaces to form an axis of pivot.

In accordance with the invention, the method is characterized in that an assembly bar, having a longitudinal protrusion with a cross section adapted to said pre-determined cross section of the engagement groove, is brought into engagement, by way of said protrusion, with the engagement groove of the anchoring element so that a butt, bending resistant joint is formed therebetween, and in that the pivot member of the vane is brought into engagement with an elongate journaling groove in the assembly bar to cooperate with opposite pivot surfaces in the journaling groove to form an axis of pivot, the vane pivoting about the same.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
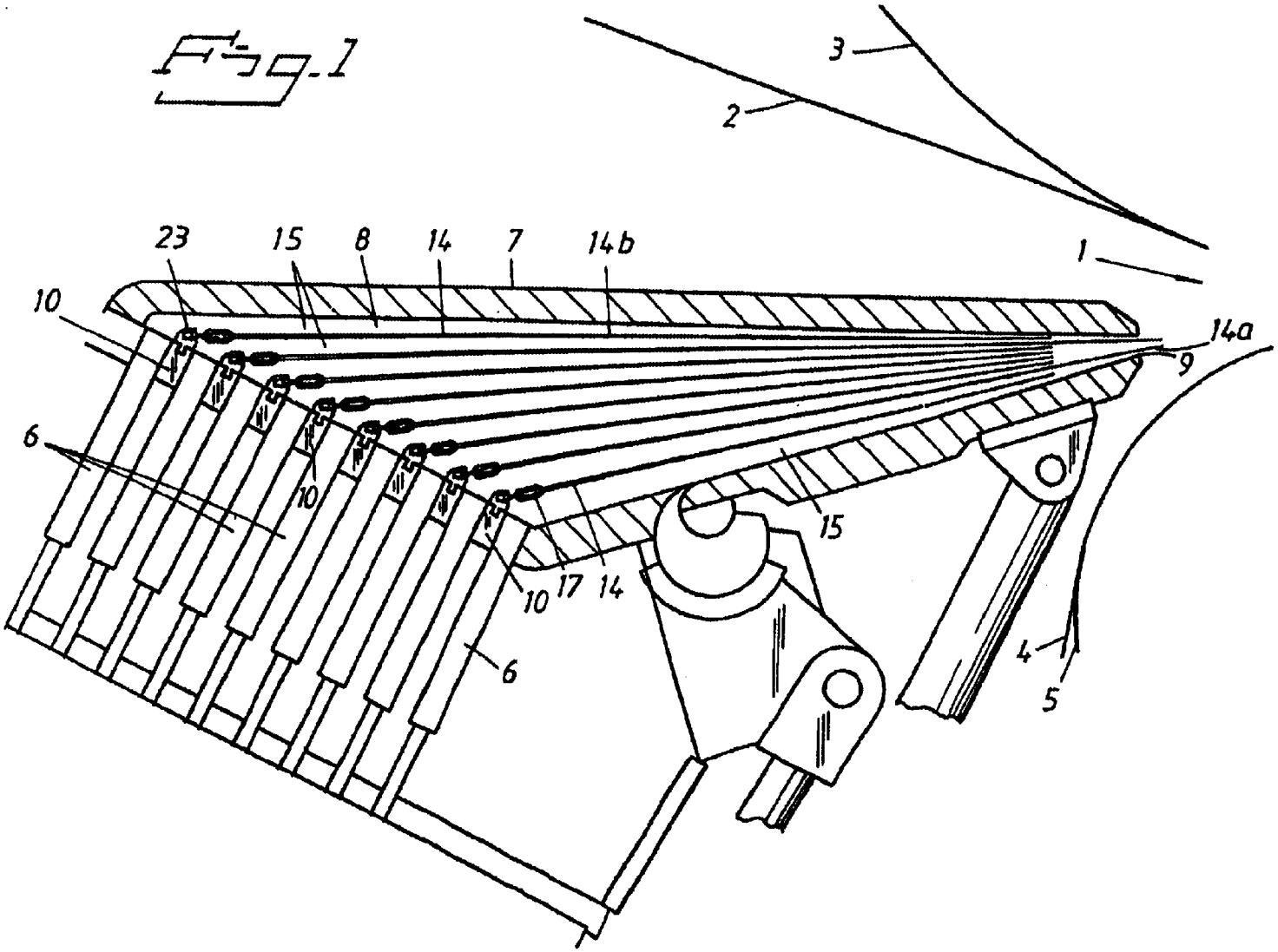
FIG. 1 shows schematically parts of a multi-layer headbox with mounting arrangements for its vanes.

FIG. 1 shows schematically a headbox, designed to deliver a three-layer jet of stock into a gap 1, leading to a forming zone in a twin-wire former of roll type. The twin-wire former has an inner forming wire 2, a rotatable forming roll 3, an outer forming wire 4 and a rotatable breast roll 5.

The headbox has a turbulence generator, comprising a group of turbulence channels 6 and a slice 7, arranged downstream of the turbulence channels 6 and containing a chamber 8 which, from its upstream end, converges in the direction of the flow of stock and, at its downstream end, terminates in a slice opening 9.

Figure 2:
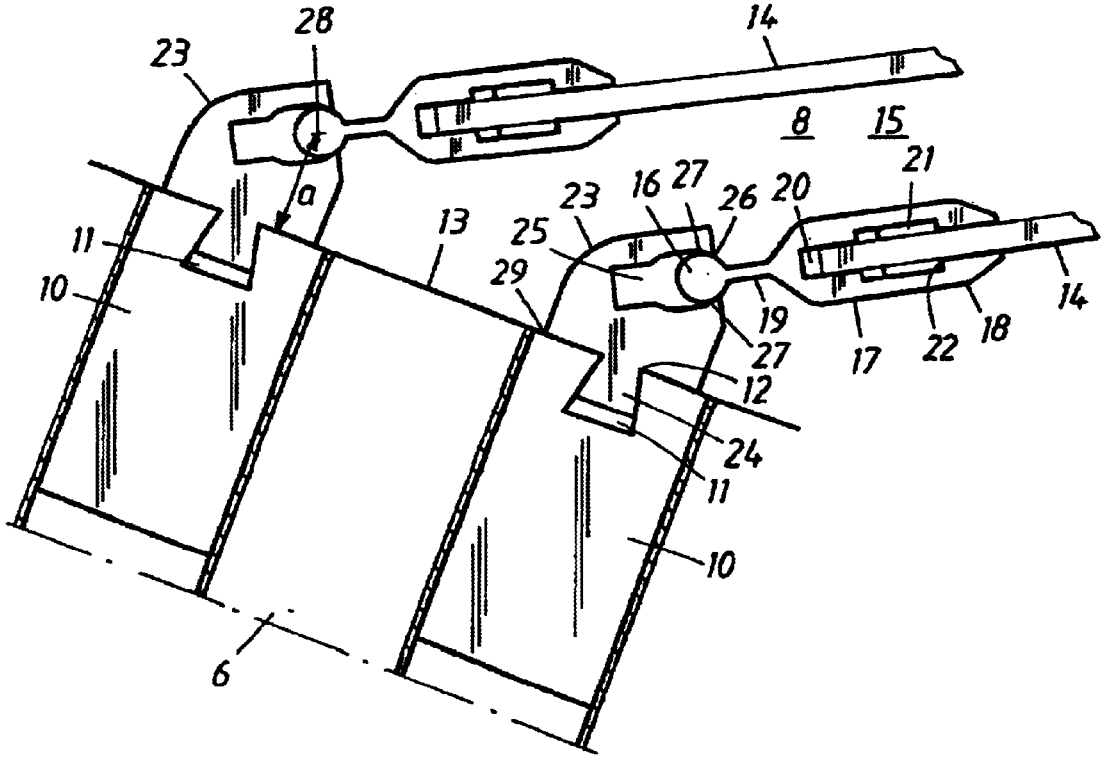
FIG. 2 shows, in an enlarged view, two vanes with mounting arrangements in accordance with FIG. 1.

The turbulence channels 6 are arranged in three sections for feeding, for instance, three different stocks into the slice chamber 8, the lower section and the upper section each having two rows of turbulence channels 6 arranged closely adjacent to each other and the middle section having four such rows of turbulence channels 6. The rows of turbulence channels 6 extend across the machine direction and adjacent rows of turbulence channels 6 are separated by elongate, steady anchoring elements 10 that extend across the machine direction. The anchoring element 10 has an elongate, continuous engagement groove 11 (see FIG. 2), which is open at its ends turned away from each other and has a side opening 12, facing the slice chamber 8. The cross section of the engagement groove 11 is dovetail-shaped. The turbulence channels 6 debouch with their discharge openings 13 directly into the slice chamber 8, and said anchoring elements 10 are located adjacent to these discharge openings 13, in level with each other, for instance, as illustrated. The group of turbulence channels 6 is, at its upstream end, connected to a feeding system (not shown), comprising three stock supplies and suitable flow distributors for even distribution of each stock to the rows of turbulence channels 6 in the appurtenant section and for even distribution of the stock within each row of turbulence channels 6.

In the embodiment shown, the headbox has eight vanes 14, dividing the slice chamber 8 into nine converging channels 15 that communicate with the rows of turbulence channels 6. Two of the vanes 14 constitute stock-separating vanes 14*a*, arranged to separate the three stocks from each other and extending at a pre-determined distance out from the slice opening 9 for forming a jet thus consisting of three layers. The stock-separating vanes 14*a* also have a turbulence-generating function. The other vanes are solely turbulence vanes 14*b*, which have their free ends located inside the slice chamber at a pre-determined distance from the slice opening. The vanes 14 are relatively stiff and can be made of a metal material, usually titanium, or of a plastic material, usually glass- or carbon-fiber-reinforced epoxy plastic. The vanes 14 are sufficiently stiff to sustain different pressures and speeds in the flows of stock. Each vane 14 has a coupling element forming part of an arrangement for detachable mounting of the vane 14 to said anchoring element 10. The coupling element in the illustrated embodiment comprises a pivot member 16. In the embodiment shown, the vane 14 comprises an elongate connection bar 17 (see FIG. 2) that is provided with said pivot member 16, which is in the shape of a rod-like pivot element with a circular cross section. The connection bar 17, which is made of metal, for instance bronze, is as long as the vane 14 is wide and comprises, in turn, a downstream engagement part 18, an intermediate part 19 and an upstream pivot-forming engagement part, which thus forms said pivot element 16. The engagement part 18 is provided with an elongate, through-running groove 20 for receiving the upstream end part of the vane 14 and engagement dowels 21 arranged in the vane 14 for securing the vane 14 and the connection bar 17 to each other seen in the machine direction. The groove 20 is provided with inner support walls 22 for the engagement dowels 21.

The dovetail engagement groove 11 of the anchoring element 10 and circular pivot element 16 of the connection bar 17 form parts of said mounting arrangement. In accordance with the present invention, the mounting arrangement further comprises a special assembly bar 23, extending along the anchoring element 10. At its upstream end, the assembly bar 23 is designed with a continuous protrusion 24, having the same dovetail shape as the engagement groove 11 of the anchoring element 10 to be received in the same with good lateral fit, i.e. without play, and to be brought into locking wedge co-operation with the engagement groove 11 with good fit, i.e. without play, between the assembly bar and the anchoring element so that the assembly bar 23 is secured to the anchoring element 10 by forming a tight joint resistant to torsion. Further, the assembly bar 23 has a continuous journaling groove 25 that extends through the downstream end part of the assembly bar 23 and is open at the ends turned away from each other of the assembly bar 23. The journaling groove 25 has a continuous side opening 26, facing the slice chamber 8 and, more particularly, the vane 14. The journaling groove 25 is dimensioned to receive without friction the circular pivot element 16 of the connection bar 17 from the side, across the machine direction, the width of the side opening 26 being smaller than that of the circular pivot element 16 so that the same is retained therein to fix the vane 14 in its longitudinal direction. The intermediate part 19 of the connection bar 17 is of a thickness that is less than the width of the side opening 26 of the journaling groove 25 to allow the vane 14 to pivot via its connection bar 17. For this purpose, the journaling groove 25 has opposite, curved, concave pivot surfaces 27, with which the circular pivot element 16 of the vane 14 is in slideable co-operation to form an axis of pivot 28 that is at right angle to the machine direction. The height of the assembly bar 23, as seen at right angle to the grooved surface 29 of the anchoring element 10, is chosen so that the distance a of the axis of pivot at right angle to the anchoring element 10 is sufficiently great to locate the vane 14 and its connection bar 17 at a sufficient distance from the discharge opening 13 of the turbulence channel 6 without detrimentally affecting the flow of stock, which is deflected after the discharge opening 13 of the turbulence channel 6. The width of the assembly bar 23 is chosen so that it acquires sufficient support surface against the surface 29 of the anchoring element 10 to absorb the torque forces arising in the assembly bar 23.

The assembly bar 23 is made of a bending resistant material, preferably metal, for instance bronze. The described dimensioning and design of the assembly bar 23, including choice of material, ensures that it will withstand the high torque it is subjected to during operation, which means that the axis of pivot 28 maintains or substantially maintains its position in relation to the anchoring element 10, i.e. without being displaced in parallel with the plane of the vane 14.

The invention can also be applied in respect of a vane that lacks a connection bar and which instead has a corresponding pivot element fashioned at its upstream edge or a pivot element arranged within its upstream end portion.

The invention has been described in connection with a multi-layer headbox. Obviously, it can be applied to a single-layer headbox provided with one or several turbulence vanes.

The invention is particularly applicable in respect of a headbox in which all the vanes form an obtuse angle with the turbulence channels so that the flows of stock change direction when they enter the slice chamber, as illustrated in FIG. 1. However, it is applicable in respect of a rectilinear headbox, in which the turbulence channels and the slice chamber are designed so that no such change of direction occurs or occurs only in respect of the outer vanes.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A headbox for delivering a flow of stock to a forming zone in a former for wet-forming a fiber web, comprising:

a slice defining a slice chamber and a slice opening;

at least one vane arranged in the slice chamber to divide the flow of stock into at least two separate channels;

a turbulence generator coupled with the slice, the turbulence generator defining a plurality of turbulence channels corresponding to the number of channels in the slice chamber, each turbulence channel feeding stock to one of the channels in the slice chamber, the turbulence generator having an anchoring element for each vane, each anchoring element being arranged between adjacent turbulence channels; and a mounting arrangement for mounting each vane to the corresponding anchoring element, the mounting arrangement comprising:

a pivot member rigidly connected with an upstream end of the vane, the pivot member extending in the cross-machine direction;

a continuous engagement groove defined in the anchoring element, the engagement groove extending in the cross-machine direction and being open toward the slice chamber; and an assembly bar extending along the anchoring element and having a protrusion configured to be received in the engagement groove to form a rigid joint between the assembly bar and the anchoring element, and having a continuous journaling groove configured to receive the pivot member connected with the vane to fix the vane to the assembly bar while leaving the vane free to pivot about a pivot axis that extends in the cross-machine direction.

2. The headbox of claim 1, wherein the journaling groove defines a pair of spaced opposed pivot surfaces that are concave toward each other.

3. The headbox of claim 1, wherein the journaling groove is arranged at a predetermined distance from the anchoring element.

4. The headbox of claim 1, wherein the journaling groove of the assembly bar has a side opening that faces in a direction forming an obtuse angle relative to a flow direction of the adjacent turbulence channel.

5. The headbox of claim 1, comprising a plurality of said vanes each mounted to one said anchoring element by said mounting arrangement, wherein the vanes form obtuse angles relative to a flow direction of the respective turbulence channels.

6. The headbox of claim 1, wherein the pivot member is formed in the upstream edge of the vane.

7. The headbox of claim 1, wherein the pivot member is formed separately from the vane and connected to the vane.

8. The headbox of claim 1, wherein the pivot member comprises a generally rod-shaped element having a substantially circular cross section.

9. The headbox of claim 1, wherein the pivot member is located in a plane defined by the vane.

10. The headbox of claim 1, wherein the assembly bar is made of metal.

11. An arrangement for mounting a vane in a headbox that delivers a flow of stock to a forming zone in a former for wet-forming a fiber web, wherein the headbox includes a slice defining a slice chamber and a slice opening, with at least one vane arranged in the slice chamber to divide the flow of stock into at least two separate channels, and a turbulence generator coupled with the slice for supplying stock into the slice chamber, the turbulence generator defining a plurality Of turbulence channels corresponding to the number of channels in the slice chamber, each turbulence channel feeding stock to one of the channels in the slice chamber, the turbulence generator having an anchoring element for each vane, each anchoring element being arranged between adjacent turbulence channels, said arrangement comprising:

a pivot member rigidly connected with an upstream end of the vane, the pivot member extending in the cross-machine direction;

a continuous engagement groove defined in the anchoring element, the engagement groove extending in the cross-machine direction and being open toward the slice chamber; and an assembly bar extending along the anchoring element and having a protrusion configured to be received in the engagement groove to form a rigid joint between the assembly bar and the anchoring element, and having a continuous journaling groove configured to receive the pivot member connected with the vane to fix the vane to the assembly bar while leaving the vane free to pivot about a pivot axis that extends in the cross-machine direction.

12. The arrangement of claim 11, wherein the journaling groove defines a pair of spaced opposed pivot surfaces that are concave toward each other.

13. The arrangement of claim 11, wherein the journaling groove is arranged at a predetermined distance front the anchoring element.

14. The arrangement of claim 11, wherein the journaling groove of the assembly bar has a side opening that faces in a direction forming an obtuse angle relative to a flow direction of the adjacent turbulence channel.

15. The arrangement of claim 11, wherein the pivot member is formed in the upstream edge of the vane.

16. The arrangement of claim 11, wherein the pivot member is formed separately from the vane and connected to the vane.

17. The arrangement of claim 11, wherein the pivot member comprises a generally rod-shaped element having a substantially circular cross section.

18. The arrangement of claim 11, wherein the pivot member is located in a plane defined by the vane.

19. The arrangement of claim 11, wherein the assembly bar is made of metal.

20. A method for mounting a vane to an anchoring element in a headbox, which anchoring element is fixed on a turbulence generator of the headbox between two adjacent turbulence channels thereof that open out into two channels on opposite sides of the vane, a side of the anchoring element that faces the vane defining an engagement groove having a predetermined cross-section, the method comprising the steps of:

providing the vane to have a pivot member rigidly connected with an upstream end of the vane, the pivot member extending in a cross-machine direction;

rigidly connecting an assembly bar to the anchoring element by engaging a protrusion formed on the assembly bar in the engagement groove of the anchoring element, the protrusion having a cross-section adapted to said predetermined cross-section of the engagement groove such that engagement of the protrusion in the engagement groove results in a rigid connection between the assembly bar and the anchoring element; and engaging the pivot member connected with the vane in an elongate journaling groove defined in the assembly bar, the pivot member cooperating with opposed pivot surfaces of the journaling groove to allow the vane to pivot relative to the assembly bar about a pivot axis.

21. The method of claim 20, further comprising the step of connecting the pivot member to the upstream end of the vane.

* * * * *